US011116377B2

(12) United States Patent
Goto et al.

(10) Patent No.: US 11,116,377 B2
(45) Date of Patent: Sep. 14, 2021

(54) ROBOT POLISHER

(71) Applicant: MAKITA CORPORATION, Anjo (JP)

(72) Inventors: Masahiko Goto, Anjo (JP); Kentaro Koura, Anjo (JP)

(73) Assignee: MAKITA CORPORATION, Anjo (JP)

( * ) Notice: Subject to any disclaimer, the term of this patent is extended or adjusted under 35 U.S.C. 154(b) by 216 days.

(21) Appl. No.: 16/463,919

(22) PCT Filed: Nov. 20, 2017

(86) PCT No.: PCT/JP2017/041657

§ 371 (c)(1),
(2) Date: May 24, 2019

(87) PCT Pub. No.: WO2018/116721

PCT Pub. Date: Jun. 28, 2018

(65) Prior Publication Data

US 2019/0290088 A1 Sep. 26, 2019

(30) Foreign Application Priority Data

Dec. 20, 2016 (JP) ..... JP2016-246895

(51) Int. Cl.
*A47L 11/164* (2006.01)
*A47L 11/283* (2006.01)
(Continued)

(52) U.S. Cl.
CPC ..... *A47L 11/16* (2013.01); *A47L 9/28* (2013.01); *A47L 11/164* (2013.01);
(Continued)

(58) Field of Classification Search
CPC ..... A47L 11/16; A47L 11/161; A47L 11/164; A47L 11/2025; A47L 11/283;
(Continued)

(56) References Cited

U.S. PATENT DOCUMENTS 10,463,219 B2 11/2019 Koura et al.
2006/0185690 A1* 8/2006 Song ..... A47L 11/34 134/21
(Continued)

FOREIGN PATENT DOCUMENTS

CN 105476556 A 4/2016
JP S55-16884 U 2/1980
(Continued)

OTHER PUBLICATIONS

Jun. 25, 2019 International Preliminary Report on Patentability issued in International Patent Application No. PCT/JP2017/041657.
(Continued)

*Primary Examiner* — Randall E Chin
(74) *Attorney, Agent, or Firm* — Oliff PLC

(57) ABSTRACT

A robot polisher has, in a box-shaped body part having a round shape in a plan view, right and left batteries, right and left wheel motors (not shown), and a pair of right and left wheels. The right and left wheel motors are rotationally driven by using the batteries as power supplies. The pair of right and left wheels can be individually rotated forward/backward by the respective wheel motors. On a lower housing, at the front-side lower part of the body part, a pair of right and left brushes are downwardly attached, which rotate in directions opposite to each other during traveling while being in sliding contact with a floor surface.

9 Claims, 9 Drawing Sheets

(51) Int. Cl.
*A47L 11/40* (2006.01)
*A47L 11/16* (2006.01)
*A47L 9/28* (2006.01)

(52) U.S. Cl.
CPC ..... *A47L 11/283* (2013.01); *A47L 11/4005* (2013.01); *A47L 11/4027* (2013.01); *A47L 11/4061* (2013.01); *A47L 2201/04* (2013.01)

(58) Field of Classification Search
CPC ..... A47L 11/4005; A47L 11/4013; A47L 11/4038; A47L 11/4061; A47L 11/4066; A47L 11/4072
See application file for complete search history.

(56) References Cited

U.S. PATENT DOCUMENTS

| | | | | |
|---|---|---|---|---|
| 2007/0234492 | A1 | 10/2007 | Svendsen et al. | |
| 2008/0300720 | A1* | 12/2008 | Kim | A47L 9/2805 700/245 |
| 2015/0342431 | A1* | 12/2015 | Zydek | A47L 9/0477 15/366 |
| 2016/0016207 | A1 | 1/2016 | Horie et al. | |
| 2019/0274507 | A1 | 9/2019 | Koura et al. | |

FOREIGN PATENT DOCUMENTS

| | | | |
|---|---|---|---|
| JP | H06-154143 | A | 6/1994 |
| JP | 2005-143625 | A | 6/2005 |
| JP | 2008-259331 | A | 10/2008 |
| JP | 2009-518073 | A | 5/2009 |
| JP | 2013-169490 | A | 9/2013 |
| JP | 2014-204921 | A | 10/2014 |
| JP | 2016-19974 | A | 2/2016 |
| WO | 2016/104187 | A1 | 6/2016 |

OTHER PUBLICATIONS

Feb. 20, 2018 Search Report issued in International Application No. PCT/JP2017/041657.

"Makita general catalog Oct. 2016", [online], p. 93, [searched on Dec. 1, 2016], Internet <URL: http://ecatalog.makita.co.jp/flash/administrator/20/#92>.

Aug. 31, 2020 Office Action issued in Chinese Patent Application No. 1201780077444.7.

Dec. 16, 2020 Office Action issued in Chinese Patent Application No. 201780077444.7.

Apr. 23, 2021 Office Action issued in Chinese Patent Application No. 201780077444.7.

* cited by examiner

ROBOT POLISHER

BACKGROUND OF INVENTION

This application claims the benefits of International Application No. PCT/JP2017/041657, filed on Nov. 20, 2017 and Japanese Patent Application Number No. 2016-246895 filed on Dec. 20, 2016, the entirety of which is incorporated by reference.

TECHNICAL FIELD

The present invention relates to a robot polisher for cleaning a floor surface while self-traveling.

BACKGROUND ART

Conventionally, there is known a self-traveling dust collecting robot which performs cleaning by collecting dust on a floor surface with a brush while self-traveling by rotationally driving a wheel with use of a built-in motor.

Meanwhile, a polisher disclosed in Non-Patent Literature "Makita general catalog 2016-10", [online], page 93, [searched on Dec. 1, 20161, Internet <URL:

http://ecatalog.makita.co.jp/flash/administrator/20/#92> is known as a device for polishing and glazing of a floor surface and the like.

SUMMARY OF THE INVENTION

Problems to be Solved by the Invention

The self-traveling dust collecting robot only performs collection of dust and cannot perform a cleaning work such as wiping or polishing of a floor surface. In the case of the conventional polisher, a worker is to perform a manual work by grasping the device body to push the brush onto a floor surface or the like, and this takes time and labor.

Accordingly, an object of the present invention is to provide a robot polisher capable of automatically cleaning a floor surface.

Solution to the Problems

In order to achieve the above object, the present invention is a robot polisher including a body part and a cleaning body. The body part mounts a battery for an electric tool and is capable of traveling autonomously. The cleaning body is provided to the body part and configured to be in sliding contact with a floor surface.

Preferably, the cleaning body includes a pair of right and left brushes configured to be rotationally driven.

Preferably, the brushes are configured to rotate in directions opposite to each other.

Preferably, the brushes each include a brush base having a round shape in a plan view, and a brush portion formed from multiple resin brush bristles downwardly attached to a ring-shaped area, excluding a center part, of a lower surface of the brush base.

Preferably, the brushes are located at a center part in a front-rear direction of the body part.

Preferably, the body part is provided with a pair of right and left wheels for traveling, and the wheels are provided in openings formed at centers of the brushes.

Preferably, the cleaning body is a pad mounted to a lower surface of the body part.

Preferably, the pad is formed to be a nonwoven-fabric plate having a semicircular shape in a plan view, and is detachably mounted to a front-side lower surface of the body part.

Preferably, the battery comprises a pair of batteries mounted symmetrically between right and left with respect to a center line in a front-rear direction of the body part.

Preferably, the body part has, at a bottom surface thereof, casters which are located directly under the respective batteries.

Preferably, the batteries are configured to be mounted by being inserted from above to mounting portions provided to the body part, and in a mounted state, the batteries are directed toward a center of the body part.

Preferably, the batteries are sequentially used one by one as a power supply, and the body part is provided with a remaining capacity display portion configured to display a remaining capacity of each of the batteries.

Advantageous Effects of the Invention

According to the present invention, the cleaning body to be brought into sliding contact with a floor surface is provided to the body part to which the batteries for an electric tool are mounted and which is capable of traveling autonomously, whereby a cleaning work for the floor surface can be automatically performed.

In addition, in the case where the cleaning body includes the pair of right and left brushes which are rotationally driven, the floor surface can be efficiently cleaned.

In addition, in the case where the brushes rotate in directions opposite to each other, traveling is less likely to be hampered by frictional resistances between the floor surface and the brushes, and thus it becomes possible to perform accurate autonomous traveling.

In addition, in the case of arranging the brushes at the center in the front-rear direction of the body part, the amounts of protrusions of the brushes from the body part in a plan view are reduced, so that it becomes easy to perform turning even in a narrow space, thus enabling the robot polisher to travel smoothly.

In addition, in the case where the wheels are provided in the openings formed at the centers of the brushes, deflection during traveling due to rotation of the brushes can be reduced to the minimum level.

In addition, in the case where the cleaning body is a pad provided to the lower surface of the body part, it is possible to clean a wide range of a floor surface by the entire lower surface of the pad.

DESCRIPTION OF EMBODIMENTS

Hereinafter, embodiments of the present invention will be described with reference to the drawings.

Figure 1:
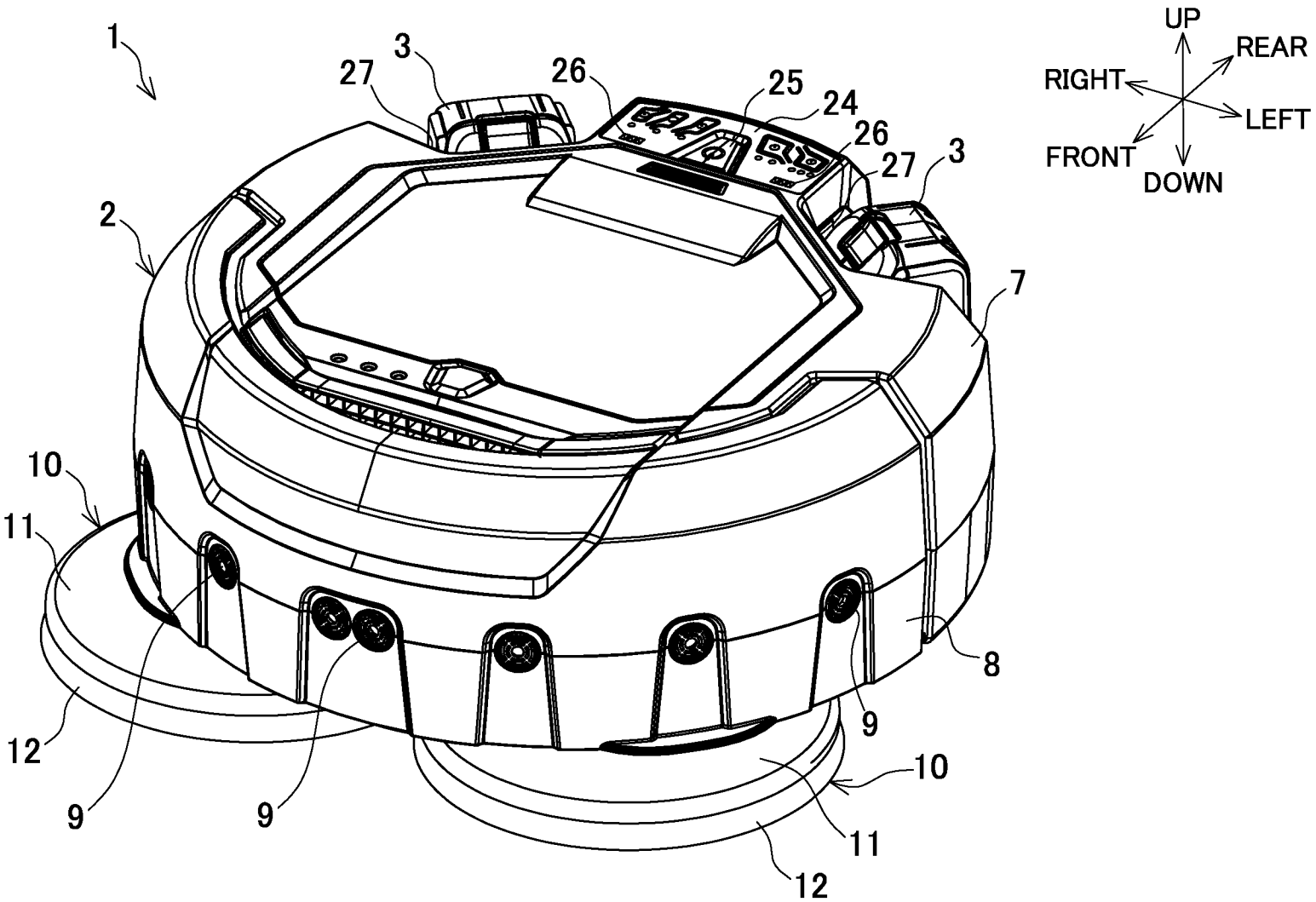
FIG. 1 is a perspective view of a robot polisher.
Figure 2:
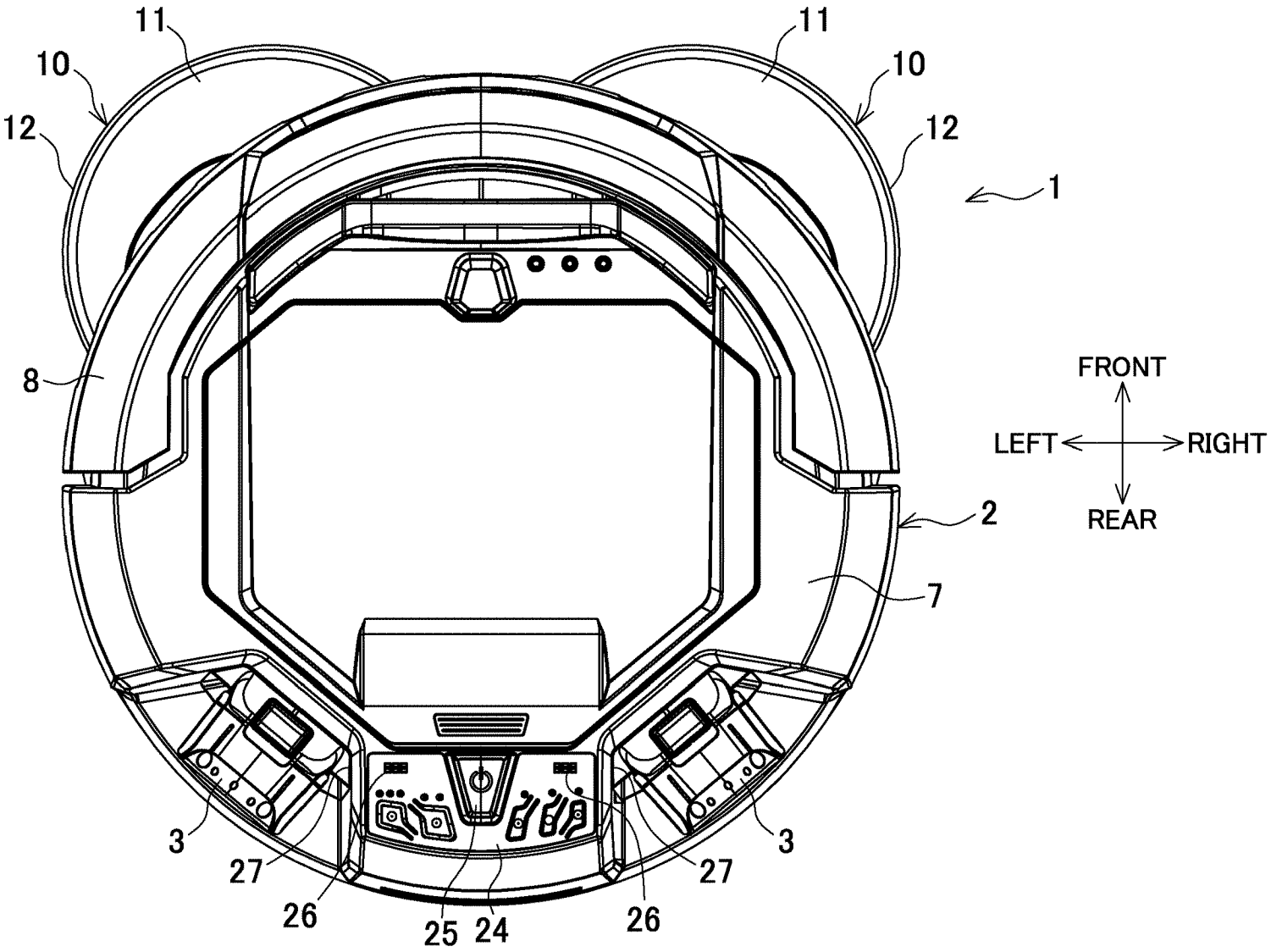
FIG. 2 is a plan view of the robot polisher.
Figure 3:
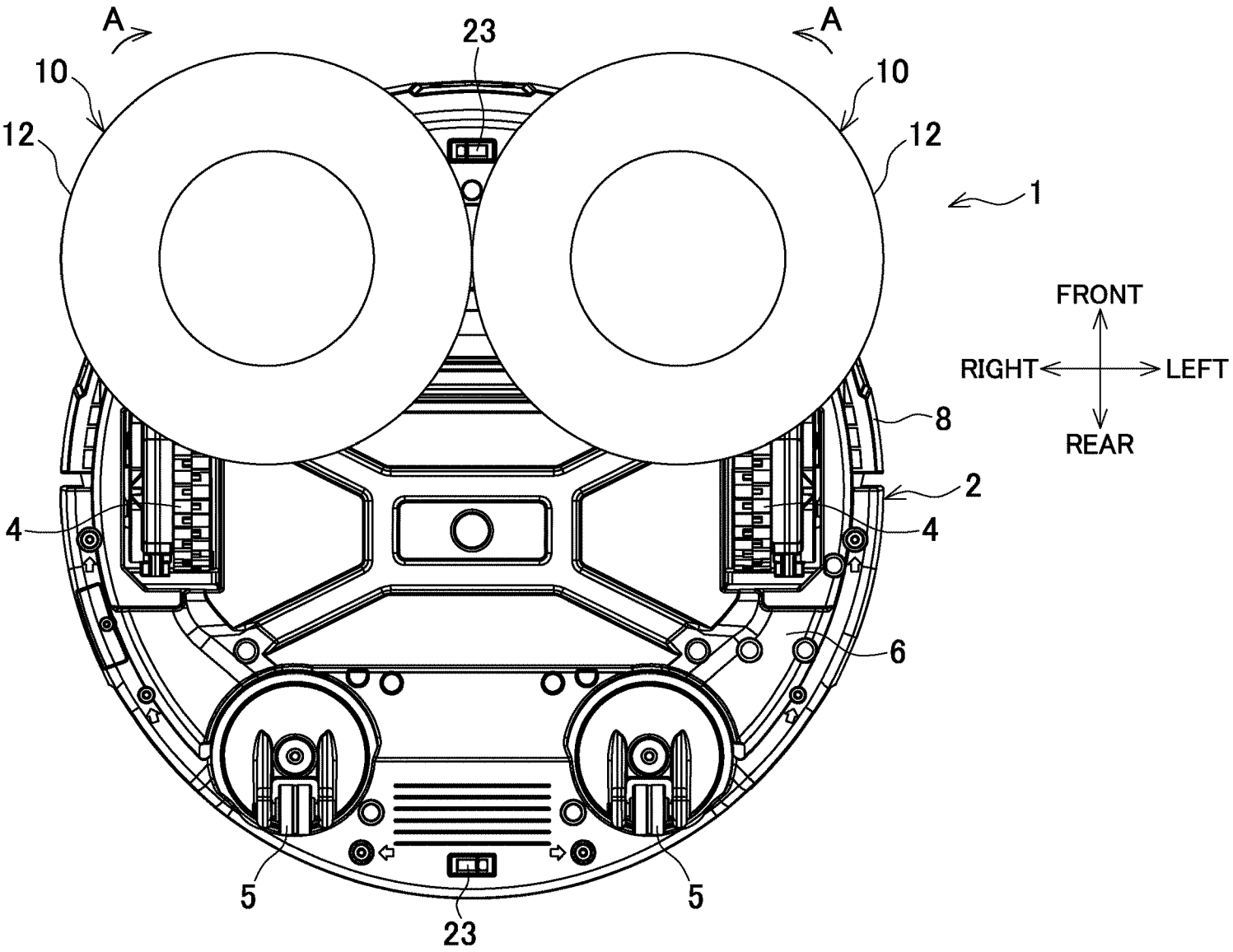
FIG. 3 is a bottom view of the robot polisher.

FIG. 1 is a perspective view showing an example of a robot polisher as seen from the upper side, FIG. 2 is a plan view thereof, and FIG. 3 is a bottom view thereof.

A robot polisher 1 has, in a box-shaped body part 2 having a round shape in a plan view, right and left batteries 3, right and left wheel motors (not shown), and a pair of right and left wheels 4, 4. The right and left wheel motors are rotationally driven by using the batteries 3 as power supplies. The pair of right and left wheels 4, 4 for traveling can be individually rotated forward/backward by the respective wheel motors.

The wheels 4, 4 are held so as to be movable in the up-down direction in the body part 2. When the robot polisher 1 is placed on a floor surface, lower parts of the wheels 4, 4 are protruded downward from the bottom surface of the body part 2, so as to support the body part 2 in a state of floating from the floor surface. A pair of right and left casters 5, 5 capable of rotating are respectively provided on the rear side of the bottom surface of the body part 2.

The body part 2 has a lower housing 6 which mainly forms the bottom surface, and an upper housing 7 which is formed at the rear surface and from the top surface to the side surface. At the front peripheral surface of the body part 2, obstacle sensors 9, 9, . . . for detecting obstacles on the front side in a contactless manner are provided inside, and a sensor cover 8 is attached which retracts upon contact with an obstacle and turns on a collision sensor (not shown) provided inside.

Figure 4A:
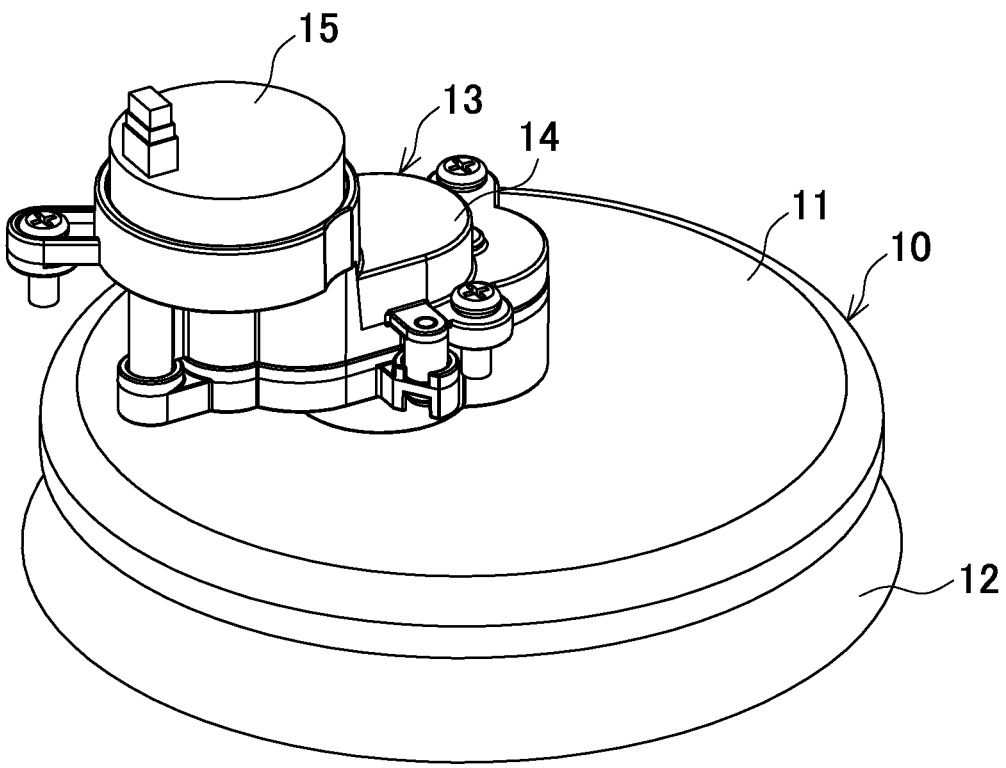
FIGS. 4A and 4B illustrate a brush part, FIG. 4A showing a perspective view and FIG. 4B showing a sectional view.
Figure 4B:
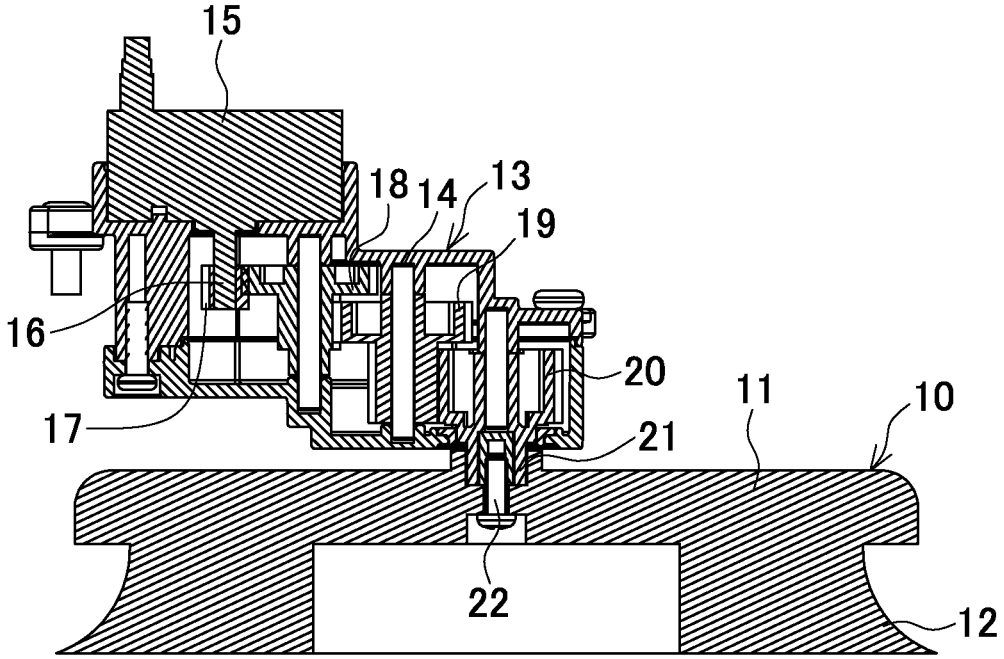

On the lower housing 6, at the front-side lower part of the body part 2, a pair of right and left brushes 10, 10 as cleaning bodies are attached in the downward direction. As shown in FIG. 4, each brush 10 is formed such that a brush portion 12 is provided in a ring-shaped area excluding a center part on the lower surface of a brush base 11 having a round shape in a plan view. The brush portion 12 is formed by attaching multiple resin brush bristles in the downward direction. On the upper surface of the brush base 11, a gearbox 13 is provided.

In the gearbox 13, a motor 15 is mounted on the upper side of a casing 14 with a rotary shaft 16 directed downward, and in the casing 14, a first gear 18 engaged with a pinion 17 of the rotary shaft 16, a second gear 19 engaged with the the first gear 18, and a third gear 20 engaged with the second gear 19 are provided in parallel with each other. An output shaft 21 provided at the lower end of the third gear 20 protrudes downward from the casing 14 and is detachably connected to a center part of the brush base 11 by a screw 22.

Such gearboxes 13, 13 are screwed on the upper side of the lower housing 6, whereby, as shown in FIG. 3, the brushes 10, 10 are supported at the front-side lower part of the body part 2 in a state where the brush portions 12 are adjacent to each other, and each brush rotates in the direction of arrow A.

At the bottom surface of the body part 2, a plurality of fall prevention sensors 23, 23, . . . are provided for detecting presence/absence of a floor surface.

Further on the upper housing 7, at the rear-side center of the body part 2, a power button 25 and remaining capacity display portions 26, 26 for the batteries 3 are provided, and in addition, an operation portion 24 including operation buttons such as a traveling pattern selection button is provided.

At the right and left of the operation portion 24, mounting portions 27, 27 for the batteries 3, 3 are formed in a cutout shape. The mounting portions 27 are located symmetrically between right and left with respect to the center line in the front-rear direction of the body part 2. Each battery 3 mounted to the mounting portion 27 is a lithium ion battery (battery pack) used as a power supply for an electric tool, and each mounting portion 27 has the same structure as a mounting portion provided to such an electric tool. That is, at the backmost part of each mounting portion 27, a pair of guide rails (not shown) to be fitted from outer sides to rails provided at a coupling portion of the battery 3 are formed in the upward direction, and a terminal block (not shown) having positive and negative terminal plates is provided in the upward direction between the guide rails. Therefore, when the battery 3 is inserted to the mounting portion 27 from the upper side, the rails are fitted to the guide rails so as to establish coupling and the terminal block is electrically connected to connection terminals provided at the coupling portion of the battery 3. Thus, since the batteries 3 for an electric tool are used as power supplies, it is not necessary to prepare different batteries for respective device types, versatility is obtained, and cost and management labor can be eliminated.

Here, each mounting portion 27 is formed to be inclined from the front-rear direction such that the backmost surface thereof to which the battery 3 is to be coupled is along the tangential direction of the body part 2. Thus, when the batteries 3, 3 are mounted, they are directed toward the center of the body part 2. Owing to such a configuration that allows the batteries 3 to be radially mounted in an inclined manner, the batteries 3 can be arranged on the outermost side along the outer shape of the body part 2, thereby preventing occurrence of a wasteful space on the outer side of each battery 3.

Further, the batteries 3 are arranged in a balanced manner at right and left with respect to the center line in the front-rear direction of the body part 2. Therefore, even though there are two batteries 3, deviation of the center of gravity does not occur. In particular, the casters 5, 5 are positioned directly under the mounted batteries 3, 3, and therefore, stability during traveling is also improved, and even if one of the batteries 3 is not mounted, a straight advance property is not deteriorated.

When the robot polisher 1 configured as described above is set on the floor surface with the batteries 3 mounted to the mounting portions 27, the brush portions 12, 12 of the right and left brushes 10, 10 come into contact with a floor surface. Here, if the power button 25 of the operation portion 24 is pressed and a driving mode is selected, the wheel motors are driven to rotate the wheels 4, 4, and the robot polisher 1 travels on the floor surface in accordance with a program set in a storage portion of a microcomputer on a circuit board provided in the operation portion 24. At the same time, the motors 15 are driven to rotate the brushes 10, 10. Thus, the floor surface is cleaned by the brush portions 12 of the rotating brushes 10, 10.

At this time, the right and left brush portions 12, 12 are in a sliding contact state so as to rotate in contact with the floor surface constantly. Here, since the brushes 10, 10 rotate in directions opposite to each other, frictional resistances between the floor surface and the brush portions 12, 12 are reduced, and this enables the robot polisher 1 to travel stably and autonomously.

During traveling, the microcomputer controls the wheel motors so as to enable the robot polisher 1 to travel on a substantially flat floor surface with no obstacles while performing detection of obstacles in the traveling direction in advance by the obstacle sensors 9, detection of presence/absence of a floor surface by the fall prevention sensors 23, detection of collision by the collision sensor, and the like.

The batteries 3, 3 are sequentially used one by one as a power supply, and the remaining capacities of the batteries 3 are displayed on the remaining capacity display portions 26, 26 provided on the operation portion 24. Therefore, if the remaining capacity of one of the batteries 3 is exhausted first, this battery 3 can be extracted from the mounting portion 27 and charged by an external charger. In this case, driving can be performed with the other battery 3 alone, and since the casters 5, 5 are provided symmetrically between right and left as described above, it is possible to perform stable traveling owing to the right and left casters 5, 5 even though the center of gravity of the body part 2 may deviate because of the single battery 3.

As described above, in the robot polisher 1 according to the above embodiment, the cleaning bodies (brushes 10) to be brought into sliding contact with a floor surface are provided to the body part 2 to which the batteries 3 for an electric tool are mounted and which is capable of traveling autonomously, whereby a cleaning work for the floor surface can be automatically performed.

Here, in particular, the pair of right and left brushes 10, 10 which are rotationally driven are used as the cleaning bodies, whereby the floor surface can be efficiently cleaned.

In addition, since the brushes 10, 10 rotate in directions opposite to each other, traveling is less likely to be hampered by frictional resistances between the floor surface and the brushes 10, 10, and thus it becomes possible to perform accurate autonomous traveling.

Figure 5:
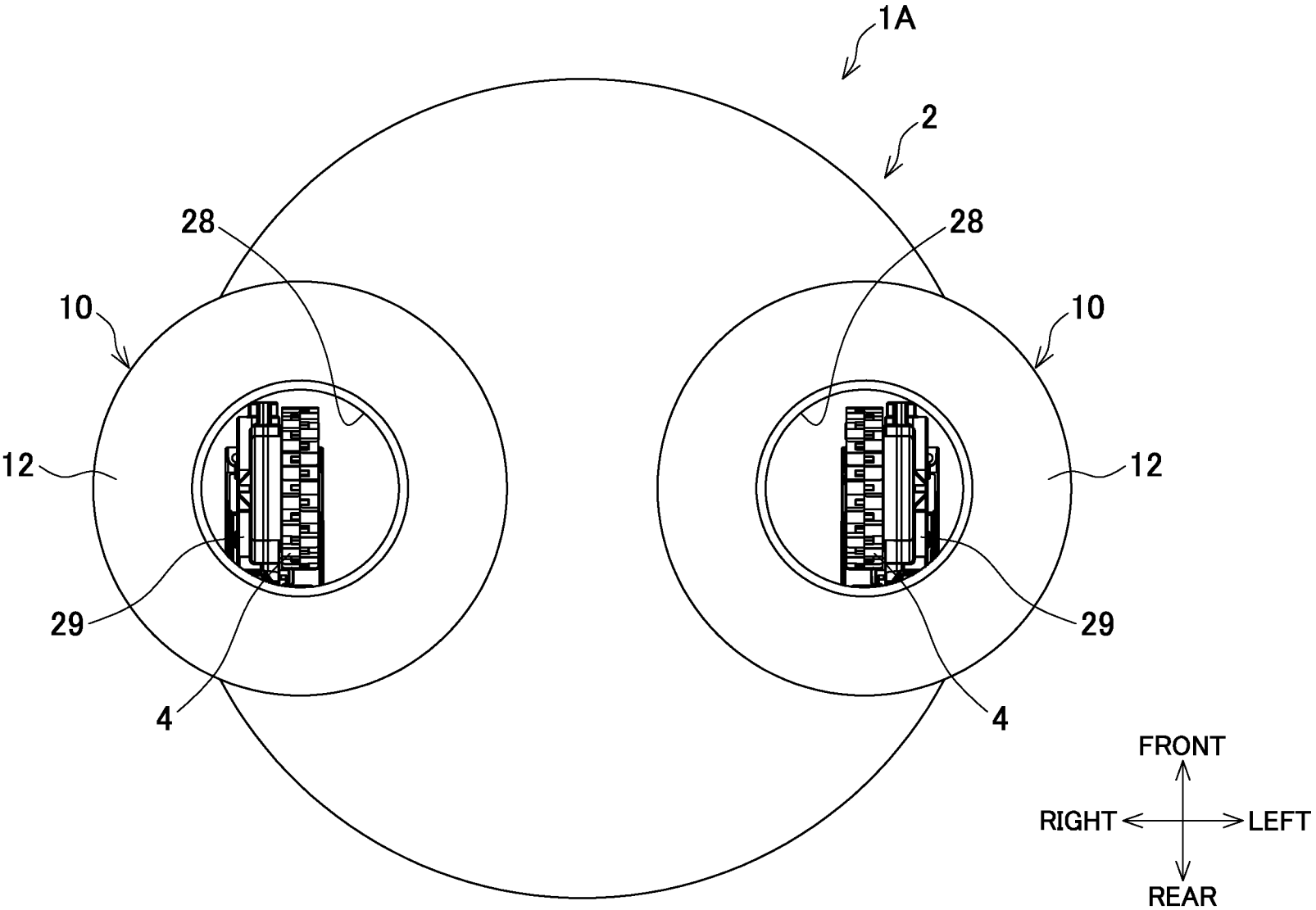
FIG. 5 is a bottom view showing a modification of the robot polisher.
Figure 6:
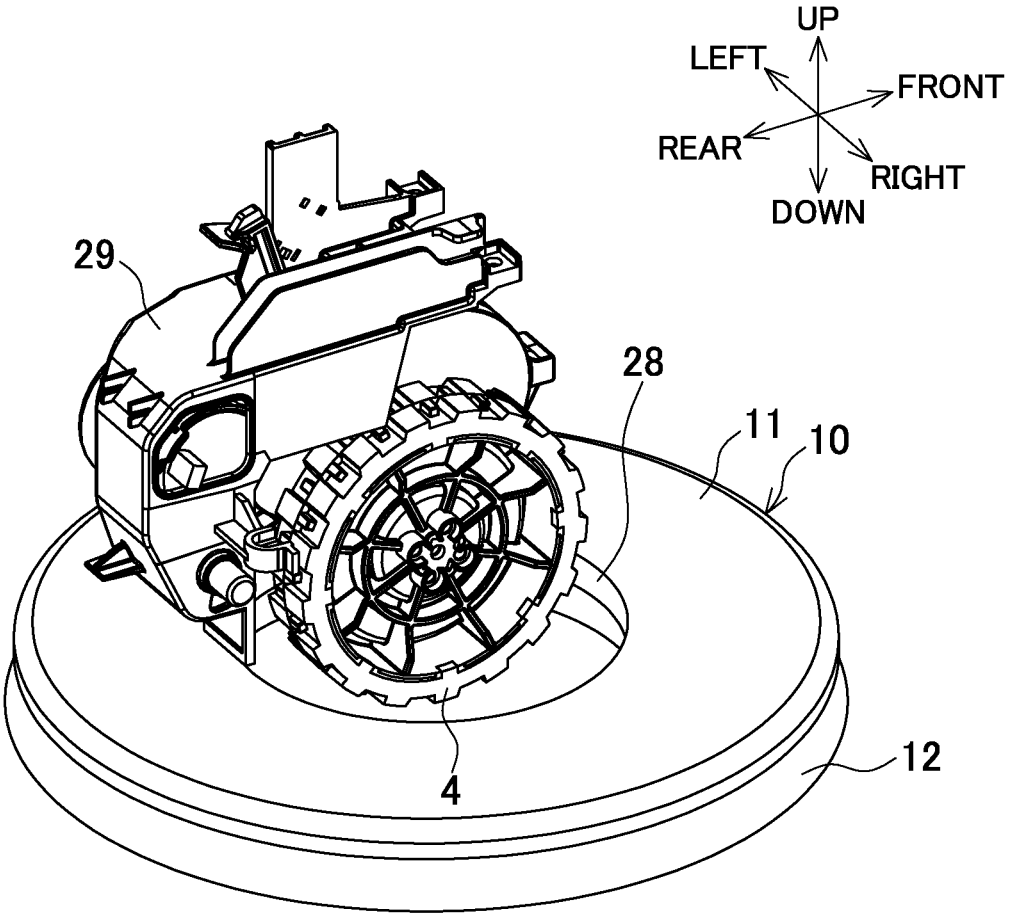
FIG. 6 is a perspective view of a part including a wheel and a brush in FIG. 5.

In the above embodiment, the right and left brushes are located on the front side of the body part. However, as in a robot polisher 1A shown in FIG. 5, the brushes 10, 10 may be provided at the positions of the wheels 4, 4. In this case, as shown in FIG. 6, an opening 28 is formed at the center of each brush base 11 and the wheel 4 is supported so as to protrude downward through the opening 28, so that the wheel 4 and the brush portion 12 have contact with a floor surface at the same time. Reference character 29 denotes a driving unit to which the wheel 4 is connected and which stores a wheel motor and a gear portion (not shown) therein. In this case, it is impossible to rotate the brush 10 by the gearbox 13 located directly above the brush 10. Therefore, for example, it is conceivable that a ring-shaped rack portion provided on the outer peripheral upper surface of the brush base 11 is engaged with a lateral-direction bevel gear to which rotation is transmitted from a motor, thereby rotating the brush 10. Alternatively, it is conceivable that the gear in the driving unit 29 is exposed downward so as to be engaged with the rack portion.

In the case of arranging the brushes 10, 10 at the center in the front-rear direction of the body part 2 as described above, the amounts of protrusions of the brushes 10, 10 from the body part 2 in a plan view are reduced, so that it becomes easy to perform turning even in a narrow space, thus enabling the robot polisher 1A to travel smoothly.

In addition, since the wheels 4, 4 are provided in the openings 28, 28 formed at the centers of the brushes 10, 10, deflection during traveling due to rotation of the brushes 10, 10 can be reduced to the minimum level.

The cleaning bodies are not limited to brushes, but may be, for example, a disk-shaped pad or mop formed from nonwoven fabric or the like, thereby enabling a polishing work or a glazing work. In this case, if the same attachment structure as for the brushes is applied to the pad or the mop, it becomes possible to perform exchange thereof as necessary.

Figure 7:
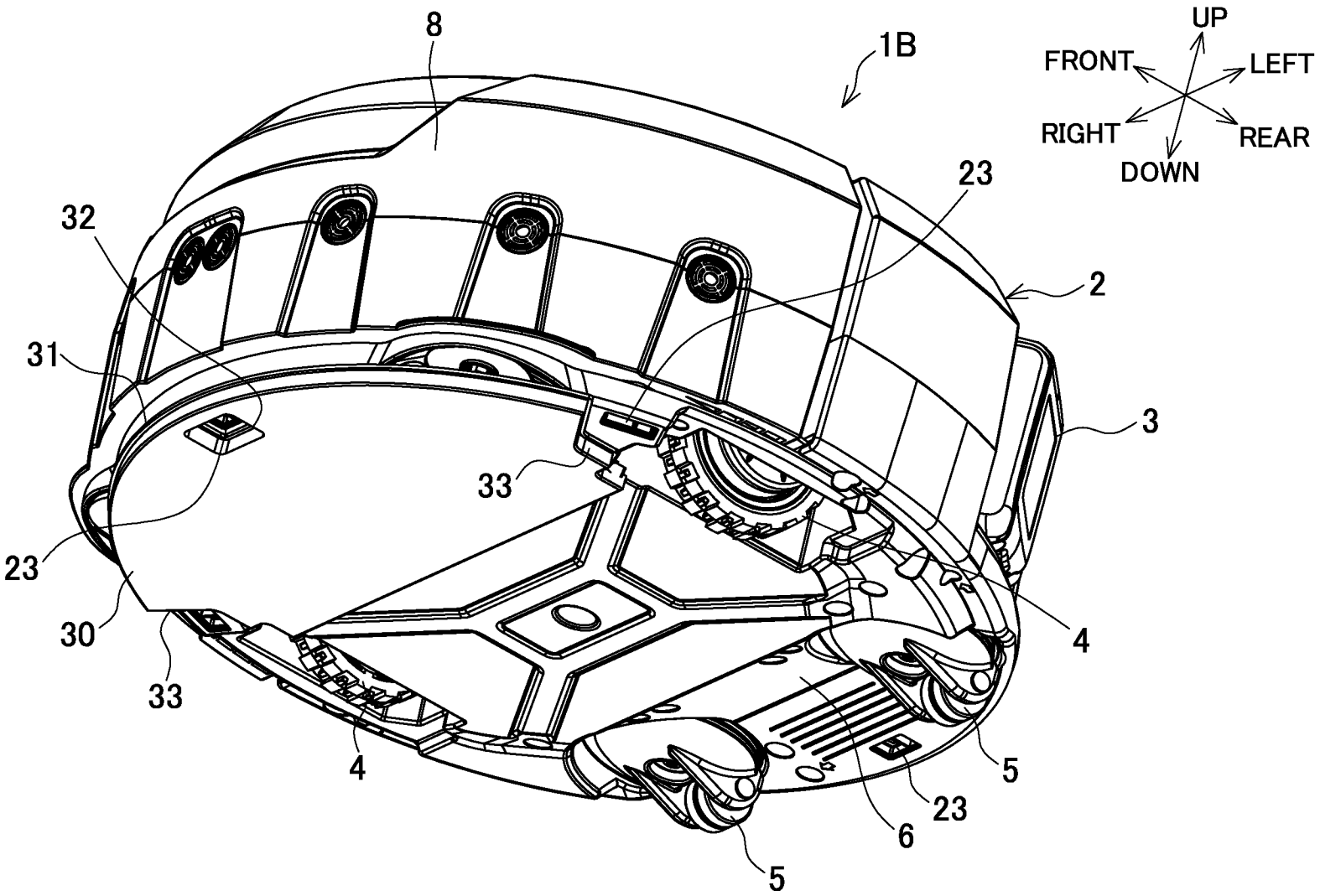
FIG. 7 is a perspective view showing a modification of the robot polisher, as seen from the bottom side.
Figure 8:
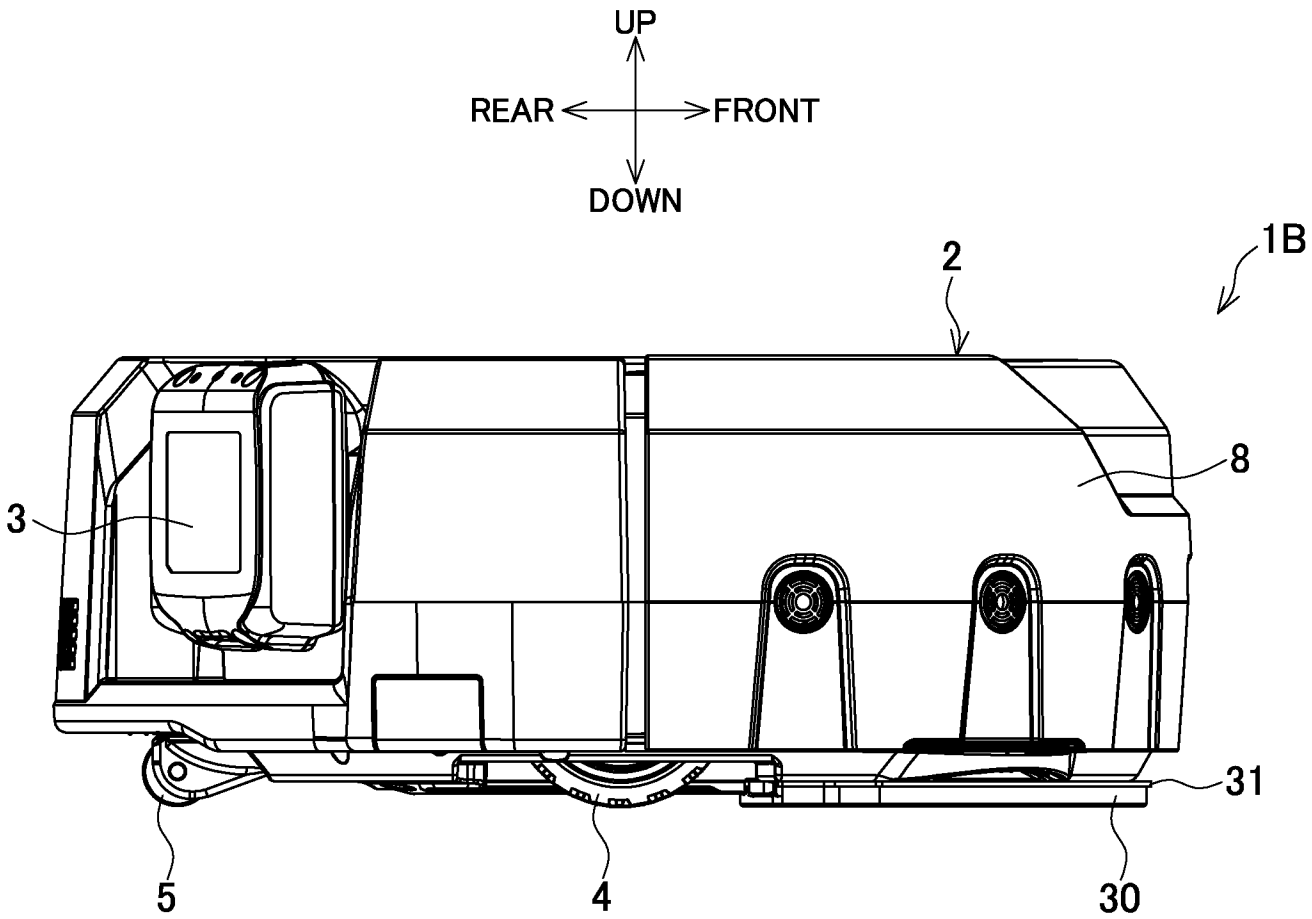
FIG. 8 is a side view showing the modification of the robot polisher.
Figure 9:
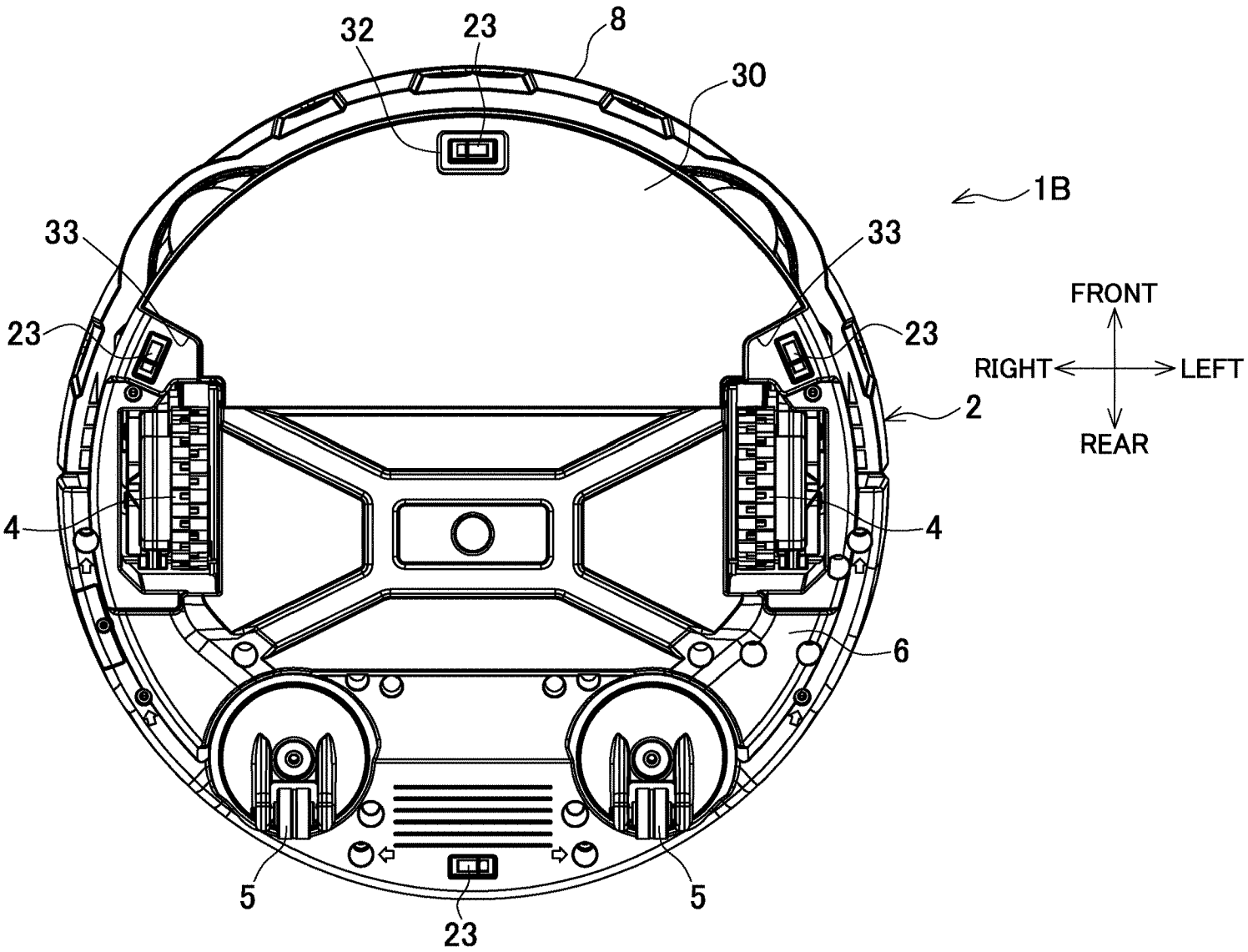
FIG. 9 is a bottom view showing the modification of the robot polisher.

As in a robot polisher 1B shown in FIGS. 7 to 9, instead of rotating brushes, pads, or the like, a plate-shaped pad may be provided as the cleaning body. Here, on the front-side lower surface of the body part 2, a pad 30 which is made of nonwoven-fabric or the like and which has a semicircular shape in a plan view and has a predetermined thickness, is detachably mounted via a hook-and-loop fastener 31. Reference character 32 denotes a window through which the fall prevention sensor 23 provided at the center on the front side is exposed, and reference characters 33 denote cutouts through which the right and left fall prevention sensors 23 are exposed.

The pad 30 is configured so that the entire lower surface thereof and the wheels 4 have contact with a floor surface at the same time, and during traveling, the entire lower surface of the pad 30 is in sliding contact with the floor surface, whereby it is possible to perform cleaning over a wide range. In this case, it is more effective that a detergent tank or the like is stored in the body part 2 and the detergent is supplied to the pad 30 on a predetermined amount basis. This is also applicable to the case of brush or pad. If the pad 30 has been stained, the pad 30 can be detached from the hook-and-loop fastener 31 so as to be cleaned or exchanged.

On the other hand, in the case of using two brushes, pads, or the like that rotate, an acceleration sensor may be provided in the body part to detect vibration during traveling, and the rotation speeds of the two brushes or the like may be individually controlled in accordance with the detected vibration, whereby vibration during traveling can be reduced.

Besides, collection of dust may be performed at the same time by using, in combination, a lateral-direction brush for scraping up dust, and providing a dust accumulating portion in the body part.

The number of the batteries is not limited to two. Three or more batteries may be provided as long as the batteries can be arranged so as to be balanced between right and left. Instead of the batteries for an electric tool, a dedicated battery may be mounted inside.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

The invention claimed is:

1. A robot polisher comprising:

a body part (1) configured to (a) receive, engage and retain a battery for an electric tool and (b) travel autonomously and (2) that includes (a) a pair of right and left wheels and (b) a wheel motor configured to rotate the pair of right and left wheels; and a cleaning body (1) provided to the body part, (2) configured to be in sliding contact with a floor surface and (3) comprising a pair of right and left brushes configured to be rotationally driven, wherein:

each of the pair of right and left wheels is in an opening at a center of one of the pair of right and left brushes; and the pair of right and left wheels are located in a central part of the body part in a front-rear direction.

2. The robot polisher according to claim 1, wherein the pair of right and left brushes are configured to rotate in directions opposite to each other.

3. The robot polisher according to claim 1, wherein each of the pair of right and left brushes includes a brush base having a round shape in a plan view, and a brush portion formed from multiple resin brush bristles downwardly attached to a ring-shaped area, excluding a center part, of a lower surface of the brush base.

4. The robot polisher according to claim 1, wherein the cleaning body is a pad mounted to a lower surface of the body part.

5. The robot polisher according to claim 4, wherein the pad is formed to be a nonwoven-fabric plate having a semicircular shape in a plan view, and is detachably mounted to a front-side lower surface of the body part.

6. The robot polisher according to claim 1, wherein the battery comprises a pair of batteries mounted symmetrically between right and left with respect to a center line in a front-rear direction of the body part.

7. The robot polisher according to claim 6, wherein the body part has, at a bottom surface thereof, casters which are located directly under the pair of batteries.

8. The robot polisher according to claim 6, wherein the batteries of the pair of batteries are configured to be mounted by being inserted from above to mounting portions of the body part, and in a mounted state, the pair of batteries are directed toward a center of the body part.

9. The robot polisher according to claim 6, wherein the batteries of the pair of batteries are sequentially used one by one as a power supply, and the body part has a remaining capacity display portion configured to display a remaining capacity of each of the pair of batteries.

* * * * *